United States Patent [19]

Visentin

[11] 4,105,051

[45] Aug. 8, 1978

[54] PREFABRICATED COMPOSABLE DUCT ELEMENT

[76] Inventor: Andrea Visentin, Via IV Novembre 56, Treviso, Italy

[21] Appl. No.: 706,708

[22] Filed: Jul. 19, 1976

[30] Foreign Application Priority Data

Jul. 25, 1975 [IT] Italy ..... 82535 A/75

[51] Int. Cl.[2] ..... F16L 9/00

[52] U.S. Cl. ..... 138/162; 138/100; 138/157; 285/330; 285/419; 403/339

[58] Field of Search ..... 138/100, 157, 156, 162, 138/169; 403/339, 340; 285/419, 373, 330; 174/101

[56] References Cited

U.S. PATENT DOCUMENTS

| | | | |
|---|---|---|---|
| 378,561 | 2/1888 | Waring | 138/157 |
| 556,819 | 3/1896 | Hartman | 138/156 |
| 825,392 | 10/1906 | Keenan | 285/330 |
| 867,945 | 10/1907 | Carson | 138/157 |
| 889,745 | 6/1908 | Beach | 138/100 |
| 1,527,300 | 2/1925 | Haerther | 138/161 |
| 2,460,957 | 2/1949 | Whitfield | 285/330 |
| 2,931,674 | 4/1960 | Davies | 403/340 |
| 3,628,572 | 12/1971 | Shannon | 138/156 |

FOREIGN PATENT DOCUMENTS

| | | | |
|---|---|---|---|
| 1,565,562 | 3/1969 | France | 285/330 |

*Primary Examiner*—Richard E. Aegerter
*Assistant Examiner*—John W. Shepperd
*Attorney, Agent, or Firm*—Guido Modiano; Albert Josif

[57] ABSTRACT

A prefabricated composable duct element for piping aeriform fluids in general and for use in erecting concrete casting boxes is provided. The duct element may be connected to further duct elements to constitute conventional ducts such as straights of various lengths, bend or elbows, multi-way unions, cap elements for closing heads and the like. All such elements are provided at each end thereof with joint connection means each including at least one male part and at least one female part for the coupling thereof with any adjoining one of said elements.

5 Claims, 14 Drawing Figures

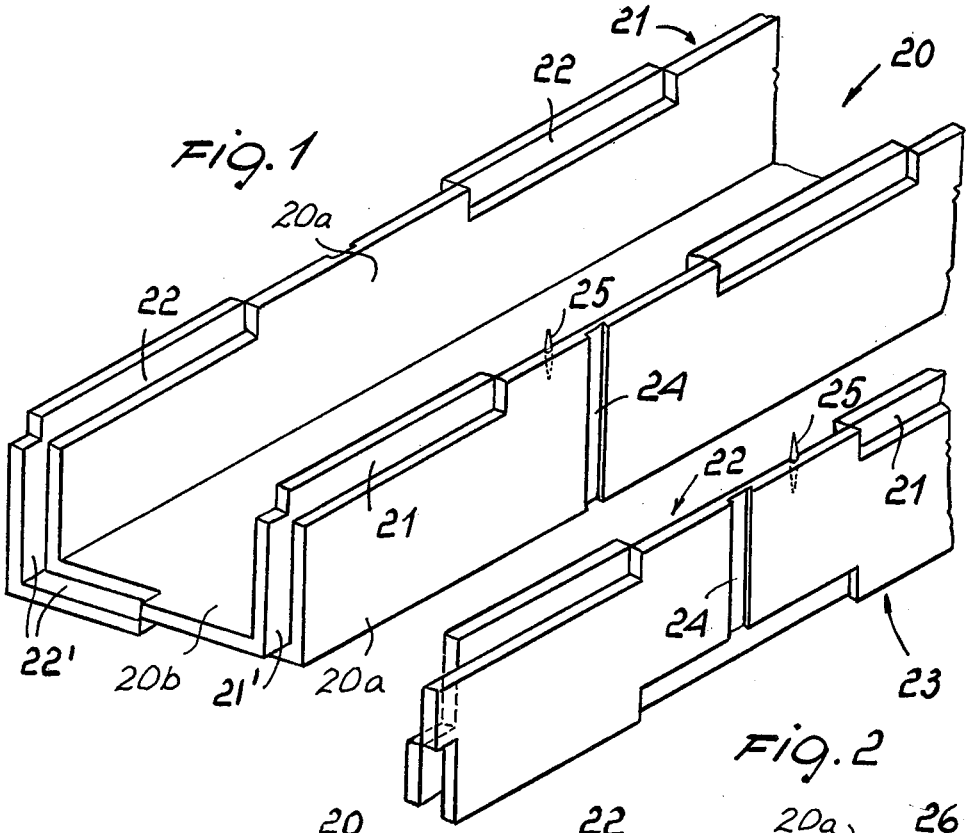
Fig. 1
Fig. 2
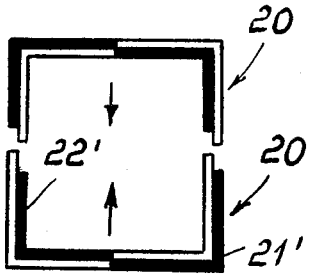
Fig. 3
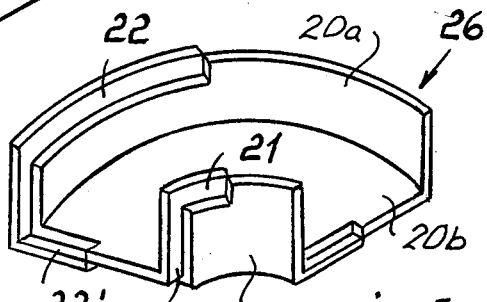
Fig. 5
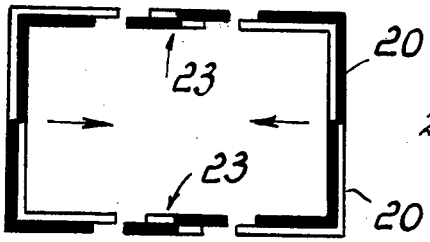
Fig. 4
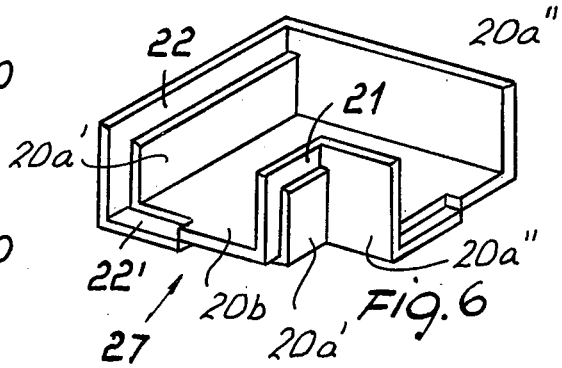
Fig. 6

PREFABRICATED COMPOSABLE DUCT ELEMENT

BACKGROUND OF THE INVENTION

This invention relates to a prefabricated composable duct element suitable for piping aeriform fluids in general, as well as for use as concrete casting boxes.

A piping system is known to comprise a number of ducting portions, i.e. straights, bends or elbows, unions or multi-way crossings, possibly with different cross-sectional areas, as well as interconnecting rings, and so forth.

SUMMARY OF THE INVENTION

It is a primary object of this invention to provide prefabricated duct elements, which may be directly assembled in the field following the system layout by means of an extremely quick and practical coupling together of the elements.

It is another object of the invention to provide a duct element made of a low specific gravity material, in order to keep weight low, such as wood, asbestos cement, expanded polystyrene, etc.; in particular, it is the latter material that has provided the best results since it is capable of withstanding temperature fluctuations from −150° C to +90° C, and moreover, has insulating properties and lends itself to the application of treatments with nonflammable substances, also improving its stiffness.

It is a further object of the invention to provide a duct element made up in a manner to be specially versatile, so as to be suitable either for the circulation of aeriforms, which may be hot or cold air, under moderate pressure as typically encountered in the heating and conditioning systems of working spaces, storage rooms, and siloes, or for use as a box for concrete castings, to form raceways, columns and loops.

These and other objects, such as will be more apparent hereinafter, are achieved by a prefabricated composable duct element for piping aeriforms in general and for use as concrete casting boxes, comprising elements constituting a conventional duct, such as straights of various lengths, bends or elbows, multi-way unions, adapters, cap elements for closing heads, and the like, such elements being provided at each end thereof with jointed connection means including each at least one male part and at least one female part for the coupling thereof with any adjoining one of said elements.

BRIEF DESCRIPTION OF THE DRAWINGS

The features and advantages of the invention will be more apparent from the ensueing description of a preferred, though not exclusive, embodiment thereof, illustrated by way of example and not of limitation in the accompanying drawings, where:

FIG. 1 is a perspective view of a duct element having a straight configuration;

FIG. 2 shows an intermediate spacer element for duct cross-section adapting applications, or adapter;

FIG. 3 shows schematically the coupling of two duct elements as per FIG. 1;

FIG. 4 shows schematically the coupling of two duct elements as shown in FIG. 1 with two spacers as per FIG. 2;

FIG. 5 shows schematically another duct element having arcuate configuration;

FIG. 6 shows a duct element for an angle fitting;

DESCRIPTION OF THE PREFERRED EMBODIMENTS

Figure 7:
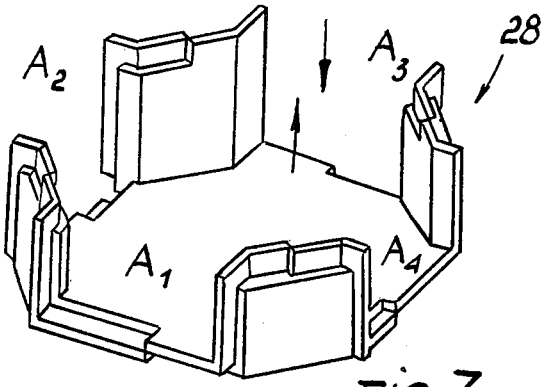
FIG. 7 is a perspective view of another duct element for a four-way union.

Making reference to the drawing figures, and in particular to FIGS. 1 and 3, there is shown a straight duct element 20 which is made of two spaced apart facing webs or walls **20*a* and a portion or wall 20*b* connecting the webs 20. When it is desired to compose a square-sectioned duct, two duct elements are assembled facing each other in opposite relationship, with the two webs having a height dimension which is substantially equal to a half side of the duct section. On the free longitudinal edges of the two webs, there are formed originally opposite notches 21 and 22, of any desired length dimension, which are alternate as outer and inner ones such as to be mutually opposing, i.e. the ones which are outer, e.g. 21, on one web, are inner on the opposite web, e.g. 22. As visible in the drawings, each of the notches provided on one side of a wall 20*a* defines a tongue on the other side of the same wall 20*a***. In this manner it becomes possible to form a jointed connection between two opposite duct elements because one of the walls defining a notch of one duct elements defines a tongue matching with a corresponding notch of the other element to be coupled.

At the heads or ends of the connecting wall **20*b* of the duct element described above, joint means are provided having a male part and a female part, which in the example discussed are represented by the notches 21' and 22', provided on the end edges of the walls 20*a* and the ends of the connecting wall 20*b*, but only as far as the centerline of the connecting walls. As visible from the drawings the notches 21' and 22' as well as the corresponding tongues defined thereby are consecutive on the connecting wall 20*b* and the adjacent wall 20*a* and are also consecutive to the adjacent notches 21 and corresponding tongues. In order to form a duct section (FIG. 3), two half duct elements are coupled toether one against the other, and since they are equal to each other, all the notches in one thereof matingly receive the tongues delimiting the notches of the other, and viceversa, while ensuring a full coplanarity of the outer and inner faces of the duct sections thus obtained. In FIG. 3, showing an elevational view of a head, a thicker line has been used to mark the jointing portions 21 and 22**, in view on the drawing, in order to make the coupling more clearly understandable. As visible from the drawings, the notches and tongues of the end portions of the connecting portion are arranged symmetrically opposite with respect to two planes extending perpendicularly to one another and half-way dividing the duct element transversally and longitudinally.

In FIGS. 2 and 4, there are illustrated intermediate elements or side spacers 23 which may have a width dimension selected as desired. Each spacer 23 is also a prefabricated element and is provided with notches 21 and 22 absolutely equal to those described above for the elements 20. It thus happens that by coupling said spacer 23 between two elements 20 facing each other, it is possible to obtain, for example, a rectangular cross-section duct as shown in FIG. 4.

The stability and tightness of the parts making up the completed piece may be ensured by securing means. Thus, the elements may be glued together, and if it is desired to increase the strength of the assembly, the elements may may be wrapped in a number of bands, possibly metallic ones, arranged peripherally and distributed along the length thereof and seated, for instance, in grooves 24 pre-arranged on the outer surfaces of the elements. Furthermore, it is possible to arrange dowels 25 penetrating corresponding holes in the element part that is to be coupled.

The foregoing should not be interpreted as limited to the two figures showing the cited sections, but is rather to be extended to any polygonal section as well as to any circular section.

FIG. 5 depicts an elbow 26 formed, for instance, with a 90° radius. The figure only shows one of the half duct elements, and it is easy to verify, by comparison, the presence of the notches 21 and 22 on the arcuate and concentrical webs or walls 20*a* and of the notches 21′ and 22′ on the element end portions. As regards the end portions, it should be noted that the notches, being as they are a mating arrangement similar to the one provided in the straight element, allow a full coupling of the elbow with the straights. In order to ensure the stability of the two elements making up the elbow, the same procedure as described for the straight may be adopted; the same applying to the insertion of any spacer element.

With reference now to FIG. 6, there is depicted a right angle duct element 27 wherein the stability is easily achieved even without the use of a metallic wrapping. The element 27 comprises two first flat portions 20*a*′ parallel to one another and two further flat portions 20*a*″ parallel to one another and arranged to form a right angle with respect to the two first flat portions. Any straight spacers 23 are obviously as long as the respective web portions and will be arranged between two spaced apart superposed elements 27 engaging corresponding webs thereof.

FIG. 7 shows one duct element of a four-way union 28, wherein the four ways A1, A2, A3, and A4 are arranged perpendicularly to one another.

Figure 8:
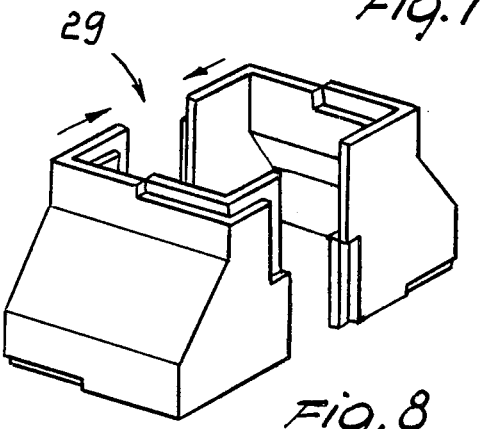
FIG. 8 shows two duct elements shaped to define an adapter.

FIG. 8 shows a straight union 29 or adapter for the changing of the section complete with the two duct elements which, when united together, form the adapter.

Figure 9:
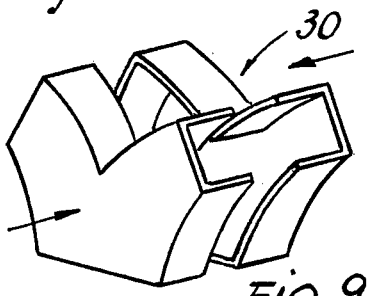
FIG. 9 shows two duct elements shaped to define a three-way fitting or union.

In FIG. 9, there is shown a three-way union 30, two of said ways being bifurcate and diverging along an arc.

Figure 10:
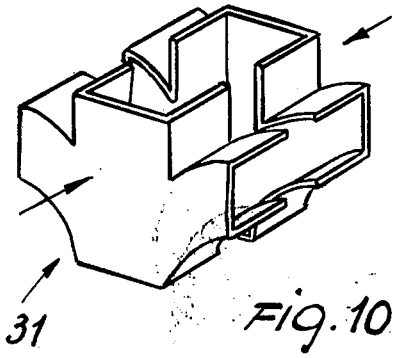
FIG. 10 shows two duct elements shaped to define a four-way union, two whereof being straight and two bifurcated to diverge along an arc.

FIG. 10 shows a four-way union 31, two of said ways being straight and two being bifurcate and divergent along an arc.

Figure 14:
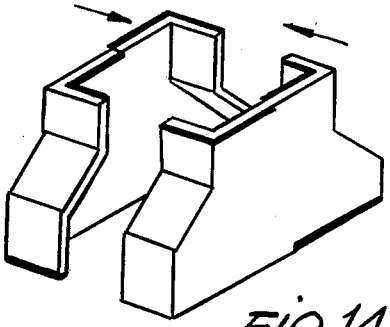
FIG. 14 shows two duct elements assemblable to define an adapter for coupling different from the adapter of FIG. 8.

FIG. 14 depicts a union similar to the one depicted in FIG. 8, with the difference, that the coupling of the two duct elements constituting the union occurs on a different plane with respet to that of FIG. 8.

From the foregoing, it will appear how the coupling of two duct elements, may be effected along the longitudinal webs and at the ends in conformity with the element configurations.

Figure 13:
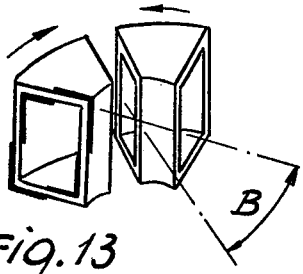
FIG. 13 shows duct elements assemblable to define an elbow.

In FIG. 13, there is shown exemplary a full section elbow having a modular bend angle B, for instance of 15° or 30°, such that the joint connection occurs at the heads which correspond with the planes forming that angle. In this case it becomes impossible to increase the section area because the spacer element 23 cannot be inserted, and a number of elbows having different sections must be provided, based upon the section of the duct at the connecting point.

Figure 11:
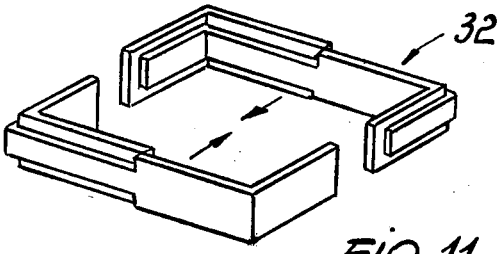
FIG. 11 shows two interconnecting elements for defining a reversible joint connection.

FIG. 11 shows coupling ring 32, also made up of two element halves, which allows the joint connection to be reversed.

Figure 12:
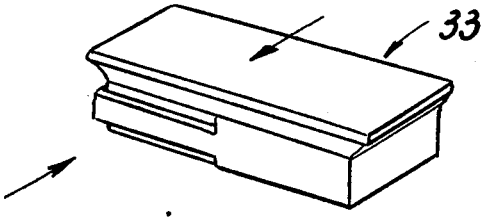
FIG. 12 shows one half of a cap element for the closing of duct heads or terminations.

FIG. 12 depicts a half cap 33 for closing a duct port.

All the composable duct elements making up a duct according to the invention are formed, of preference, from a non-metallic material, and among the latter materials, as mentioned above, expanded polystyrene and/or a similar resin has proved to be the most convenient.

Obviously, all the composable parts constituting the unions as above are herein exemplified in a few exemplary embodiments only, and it will be evident that it is possible to deduct from the latter also other substantially similar forms having the same operative feature as herein discussed.

Moreover, it will be obvious that the head notches may differ from the ones illustrated, or, in other words, that it is not necessary that they divide the head half perimeter strictly in two parts 21′ and 22′, but rather they may divide it in more than two parts or present any recessed profile.

From the foregoing, it can be seen how the possibility of providing a duct assembled from prefabricated elements that may be combined together and each made up of two symmetrical and equal parts confers special functionality to the invventive duct.

The invention as such is susceptible to many modifications and variations, all of which fall within the scope of this same inventive concept.

Furthermore, all the details may be replaced with other technically equivalent elements.

In practicing the invention, the materials used, as mentioned above, and the dimensions may be any ones to suit the applicational requirements.

I claim:

1. A composable duct element for piping aeriform fluids and for use in erecting concrete casting boxes, comprising two spaced apart facing walls and a wall connecting said facing walls to one another, each of said facing walls having edges including a longitudinal edge and two end edges opposite to one another and at a right angle with respect to said longitudinal edge, and said connecting wall having opposite ends, wherein said edges and said ends have notches and tongues for matching connection with further duct elements, the notches and tongues of said longitudinal edge of said facing walls being alternately arranged on the inner and on the outer side of facing walls and each of the notches provided on one side of each of said walls defining a corresponding tongue on the other side of the same wall and having a corresponding notch on the other side of the other of said walls, the notches and tongues of each of said opposite ends of said connecting wall being alternate and each having a corresponding notch and tongue on the opposite end arranged symmetrically opposite with respect to a plane half-way dividing said connecting wall longitudinally, and the notches and tongues of said end edges of said facing walls being consecutive to the respective adjacent notches and tongues of said longitudinal edges of said facing walls and the respective adjacent notches and tongues of said opposite ends of said connecting wall.

2. A composable duct element as claimed in claim 1, wherein said facing walls comprise straight portions extending parallel to one another and said connecting portion comprises a flat portion perpendicularly connecting said walls.

3. A composable duct element as claimed in claim 1, wherein said facing walls comprise arcuate portions arranged concentrically to one another.

4. A composable duct element as claimed in claim 1, wherein said facing walls comprise two first flat portions parallel to one another and two further flat portions parallel to one another and arranged to form an angle with respect to said two first flat portions.

5. A duct section made of removably connected composable duct elements, wherein each of said duct elements comprises two spaced apart facing walls and a wall connecting said facing walls to one another, each of said facing walls having edges including a longitudinal edge and two end edges opposite to one another and at a right angle with respect to said longitudinal edge, and said connecting wall having opposite ends, wherein said edges and said ends have notches and tongues for matching connection with further duct elements, the notches and tongues of said longitudinal edge of said facing walls being alternately arranged on the inner and on the outer side of facing walls and each of the notches provided on one side of each of said walls defining a corresponding tongue on the other side of the same wall and having a corresponding notch on the other side of the other of said walls, the notches and tongues of each of said opposite ends of said connecting wall being alternate and each having a corresponding notch and tongue on the opposite end arranged symmetrically opposite with respect to a plane half-way dividing said connecting wall longitudinally, said duct elements being arranged facing each other in opposite relationship to define a tubular duct section.

* * * * *